US011441298B2

(12) United States Patent
Stein et al.

(10) Patent No.: US 11,441,298 B2
(45) Date of Patent: Sep. 13, 2022

(54) SANITARY INSERT UNIT

(71) Applicant: Neoperl GmbH, Mullheim (DE)

(72) Inventors: Alexander Stein, Ihringen (DE); Simon Twitchett, Kidderminster (GB)

(73) Assignee: Neoperl GmbH, Müllheim (DE)

( * ) Notice: Subject to any disclaimer, the term of this patent is extended or adjusted under 35 U.S.C. 154(b) by 326 days.

(21) Appl. No.: 16/484,168

(22) PCT Filed: Jan. 15, 2018

(86) PCT No.: PCT/EP2018/050827
§ 371 (c)(1),
(2) Date: Aug. 7, 2019

(87) PCT Pub. No.: WO2018/166666
PCT Pub. Date: Sep. 20, 2018

(65) Prior Publication Data

US 2021/0285194 A1 Sep. 16, 2021

(30) Foreign Application Priority Data

Mar. 13, 2017 (DE) ..... 202017101436.3 U

(51) Int. Cl.
*E03C 1/084* (2006.01)

(52) U.S. Cl.
CPC ..... *E03C 1/084* (2013.01)

(58) Field of Classification Search
CPC ..... E03C 1/084
USPC ..... 239/428.5
See application file for complete search history.

(56) References Cited

U.S. PATENT DOCUMENTS

| | | | |
|---|---|---|---|
| 7,731,107 | B2 | 6/2010 | Grether |
| 9,353,509 | B2 | 5/2016 | Hart |
| 10,013,000 | B2 | 7/2018 | Twitchett et al. |
| 10,294,641 | B2 | 5/2019 | Stein et al. |
| 2013/0134235 | A1 | 5/2013 | Blum et al. |
| 2013/0341422 | A1 | 12/2013 | Sochtig et al. |

(Continued)

FOREIGN PATENT DOCUMENTS

| | | |
|---|---|---|
| CN | 102918213 | 2/2012 |
| CN | 203049701 | 7/2013 |

(Continued)

*Primary Examiner* — Christopher S Kim
(74) *Attorney, Agent, or Firm* — Volpe Koenig

(57) ABSTRACT

A sanitary insert unit that is fittable on the water outlet of a sanitary outlet fitting is provided, with a throughflow-quantity regulator unit which, in at least one annular throughflow channel, has at least one annular flow-restricting body of elastic material, which at least one flow-restricting body, between itself and an adjacent channel wall bearing a control profiling, bounds a control gap, the passage cross section of which is variable by the flow-restricting body deforming under the differential pressure forming during the flow therethrough. A jet regulator is arranged on the outflow side of the throughflow-quantity regulator unit and has a jet splitter which divides the water coming from the throughflow-quantity regulator unit into a multiplicity of individual jets. The jet splitter is designed as a perforated plate, and the projection of at least one of the throughflow channels is arranged in a perforation-free annular zone of the jet splitter.

11 Claims, 2 Drawing Sheets

(56) References Cited

U.S. PATENT DOCUMENTS

| | | | | |
|---|---|---|---|---|
| 2016/0002897 | A1* | 1/2016 | Tempel | E03C 1/08<br>239/428.5 |
| 2017/0371356 | A1 | 12/2017 | Twitchett | |
| 2018/0087247 | A1 | 3/2018 | Blum | |

FOREIGN PATENT DOCUMENTS

| | | |
|---|---|---|
| CN | 103443367 | 12/2013 |
| CN | 205003556 | 1/2016 |
| CN | 106200699 | 12/2016 |
| CN | 206986982 | 2/2018 |
| DE | 4413060 | 10/1995 |
| DE | 102013004076 | 9/2014 |
| DE | 102015003246 | 9/2016 |
| DE | 202015003301 | 9/2016 |
| EP | 1785193 | 5/2007 |
| WO | 2016059458 | 4/2016 |

* cited by examiner

SANITARY INSERT UNIT

BACKGROUND

The invention relates to a sanitary insert unit which can be fitted in the water outlet of a sanitary outlet fitting, with a throughflow-quantity regulator unit which, in at least one annular throughflow channel, has at least one annular flow-restricting body of elastic material, which at least one flow-restricting body, between itself and an adjacent channel wall bearing a control profiling, bounds a control gap, the passage cross section of which can be varied by the flow-restricting body deforming under the differential pressure forming during the flow therethrough, and with a jet regulator which is arranged on the outflow side of the throughflow-quantity regulator unit and has a jet splitter which divides the water coming from the throughflow-quantity regulator unit into a multiplicity of individual jets.

A sanitary insert unit of the type mentioned at the beginning which comprises an inflow-side throughflow-quantity regulator unit and an outflow-side jet regulator is already known from DE 10 2015 003 246 A1. While the throughflow-quantity regulator unit has to adjust the quantity of water flowing through per unit of time to a defined maximum value, the water in the jet regulator is shaped into a homogeneous, non-sputtering and sparkling-soft water jet. The throughflow-quantity regulator unit has two annular throughflow channels which are arranged concentrically with respect to each other and in each of which an annular flow-restricting body of elastic material is placed. The flow-restricting bodies, between themselves and a control profiling which is provided on an adjacent channel wall of the assigned through flow channel, each bound a control gap, the passage cross section of which can be varied by the flow-restricting body deforming under the differential pressure forming during the flow therethrough. The jet regulator arranged on the outflow side has a jet splitter which is designed as a diffuser and has an impingement surface which deflects the incoming water radially outwards in the direction of an annular wall. This annular wall is provided with throughflow holes which are distributed over the circumference of the wall and by which the deflected water is divided into individual jets. These throughflow holes open into an annular gap which is constricted in the throughflow direction and on the outflow side of which a negative pressure arises. By this negative pressure, ambient air can be sucked into the insert housing of the previously known insert unit and is mixed there on the outflow side of the diffuser serving as the jet splitter with the water flowing therethrough.

However, jet regulators with a jet splitter configured as a diffuser can advantageously be used above all in a certain area of application, in particular at low water pressures.

A sanitary insert unit likewise consisting of an inflow-side throughflow-quantity regulator and a jet regulator connected downstream on the outflow side is already known from DE 10 2013 004 076 A1. The jet splitter of the jet regulator used in the previously known insert unit is in the form of a perforated plate which has a central, perforation-free impingement surface. This impingement surface is bounded on the inflow-side end surface of the perforated plate by an outer first annular wall which has passage openings oriented in the radial direction and passing therethrough, wherein a respective throughflow hole through the perforated plate, said throughflow hole being connected to the passage openings, is provided on that side of the passage openings which is arranged in the impingement surface plane. The outer first annular wall is surrounded on the outer circumferential side by an annular space. Coaxially and concentrically with respect to said outer first annular wall, an inner, second annular wall which is spaced apart from the first annular wall and has a smaller diameter is provided, said second annular wall having radial passage openings which are arranged at a distance above the impingement surface and through which the water passes to the first annular wall and to the passage openings thereof and therefore to the throughflow holes of the jet splitter which is in the form of a perforated plate. The throughflow-quantity regulator, which is connected upstream on the inflow side, of the sanitary insert unit already known from DE 10 2013 004 076 A1 has only one annular throughflow channel, the projection of which is aligned in the throughflow direction with the perforation-free impingement surface. By this combination, the quantity of water flowing through the jet regulator is intended to be virtually independent of the water pressure prevailing upstream of the jet regulator.

SUMMARY

It is therefore the object to provide a sanitary insert unit of the type mentioned at the beginning which is distinguished by a broader area of use or can advantageously be used in other areas of application, wherein the speed of the water arriving from the throughflow-quantity regulator unit is intended to be controlled in such a manner that it does not emerge as a hard water jet.

This object is achieved according to the invention in the sanitary insert unit of the type mentioned at the beginning in particular in that the jet splitter is in the form of a perforated plate, in that the projection of at least one of the throughflow channels is arranged in a perforation-free annular zone of the jet splitter, in that at least one throughflow hole is provided in the central region of the jet splitter, which central region is bounded by the projection of the at least one throughflow channel, and in that the throughflow holes of the jet splitter have an inflowing hole portion and an outflowing hole portion.

The insert unit according to the invention can be fitted on the water outlet of a sanitary outlet fitting. The insert unit has an inflow-side throughflow-quantity regulator unit, on the outflow side of which a jet regulator is provided. While the throughflow-quantity regulator unit has to adjust the quantity of water flowing therethrough per unit of time to a defined maximum value irrespective of the pressure, the jet regulator of the insert unit according to the invention is intended to shape the water emerging there into a homogeneous, non-sputtering and optionally also sparkling-soft water jet.

The throughflow-quantity regulator unit of the insert unit according to the invention has at least one annular throughflow channel in which an annular flow-restricting body of elastic material is provided. The flow-restricting body located in the at least one throughflow channel, between itself and an adjacent channel wall bearing a control profiling, bounds a control gap, the passage cross section of which can be varied by the flow-restricting body deforming under the differential pressure forming during the flow therethrough. The jet regulator arranged on the outflow side of the throughflow-quantity regulator unit has a jet splitter which divides the water coming from the throughflow-quantity regulator unit into a multiplicity of individual jets. In the insert unit according to the invention, said jet splitter is designed as a perforated plate. So that the water arriving from the throughflow-quantity regulator unit optionally also at high speed cannot flow directly through the throughflow holes of the jet splitter and subsequently emerges at excessive speed as a hard water jet, it is provided according to the invention that the projection of at least one of the throughflow channels is arranged in a perforation-free annular zone of the jet splitter. Therefore, a perforation-free annular zone is provided in the jet splitter as an axial extension of at least one of the throughflow channels. At least one throughflow hole is provided in the central region of the jet splitter, which central region is bounded by the projection of the at least one throughflow channel. Since at least one throughflow hole is provided in the central region of the jet splitter, the formation of an outlet jet, which is homogeneous in jet cross section and is non-sputtering, in the jet regulator of the insert unit according to the invention is facilitated. The throughflow holes of the jet splitter here have an inflowing hole portion and an outflowing hole portion. The insert unit according to the invention is distinguished by a manner of operation which is advantageous even over large and in particular higher pressure ranges.

A particularly advantageous embodiment according to the invention, which embodiment is distinguished by minimized performance deviations, makes provision for the throughflow-quantity regulator unit to have at least two throughflow-quantity regulators, the throughflow channels of which are preferably arranged approximately concentrically with respect to each other.

In order to be able to keep the perforation-free annular zone in the jet splitter as narrow as possible, said annular zone being provided as an extension of at least one of the throughflow channels, and in order to be able to place as many throughflow holes as possible in that partial region of the jet splitter which is located outside the throughflow channels, it is advantageous if the throughflow channels of two adjacent throughflow-quantity regulators are separated from each other by an annular wall, and if the control profilings of said throughflow channels are provided on the inner side and the outer side of said annular wall.

The formation of a homogeneous outlet jet in the jet regulator of the insert unit according to the invention is facilitated if the throughflow holes of the jet splitter, which throughflow holes are arranged outside the projection of the at least one throughflow channel, are arranged on at least one circular path and preferably on at least two circular paths.

A preferred embodiment according to the invention makes provision here for the circular paths having the throughflow holes to be arranged concentrically with respect to one another and/or with respect to the projection of the at least one throughflow channel.

In the insert unit according to the invention, a jet splitter which is designed as a perforated plate and the throughflow holes of which have a round clear hole cross section is preferred.

While the inflow hole portion can taper in a funnel-shaped manner in the throughflow direction, it is advantageous if the outflow portion has a cylindrical clear hole cross section.

The functionally correct manner of operation of the insert unit according to the invention and of the throughflow-quantity regulator unit thereof is assisted if the throughflow channel having a smaller diameter is provided with a flow-restricting body with a smaller cross section, in particular a smaller chord size, in comparison to the flow-restricting body located in the throughflow channel which is external to the throughflow channel and has a larger diameter.

BRIEF DESCRIPTION OF THE DRAWINGS

Developments according to the invention emerge from the description below of a preferred exemplary embodiment in conjunction with the claims and the drawing. The invention will be described in more detail below with reference to a preferred exemplary embodiment.

In the drawing.

DETAILED DESCRIPTION

Figure 1:
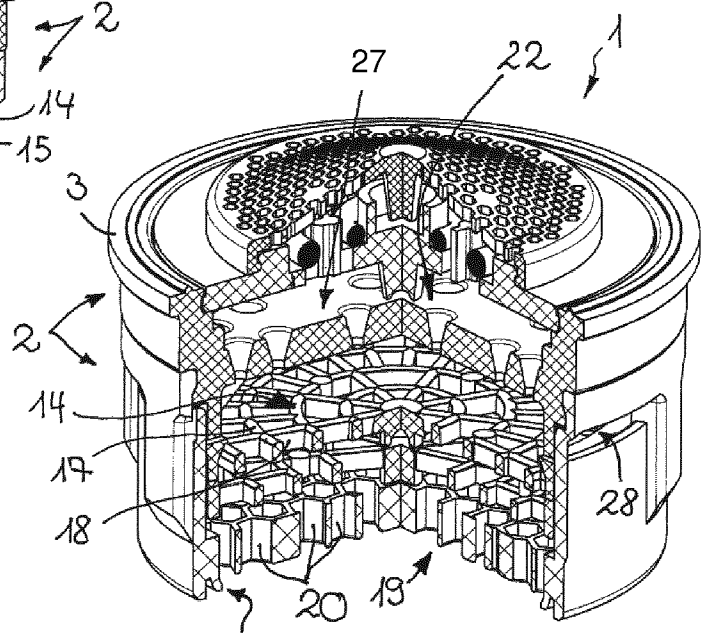
FIG. 1 shows a sanitary insert unit in a partially longitudinally sectioned perspective illustration, wherein the insert unit has a throughflow-quantity regulator unit and a jet regulator arranged on the outflow side of said throughflow-quantity regulator unit.
Figure 2:
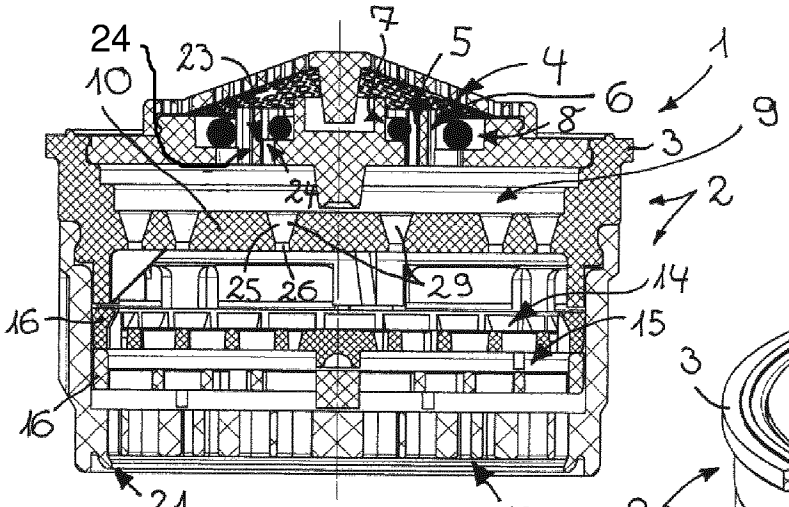
FIG. 2 shows the inert unit from FIG. 1 in a longitudinal section.
Figure 3:
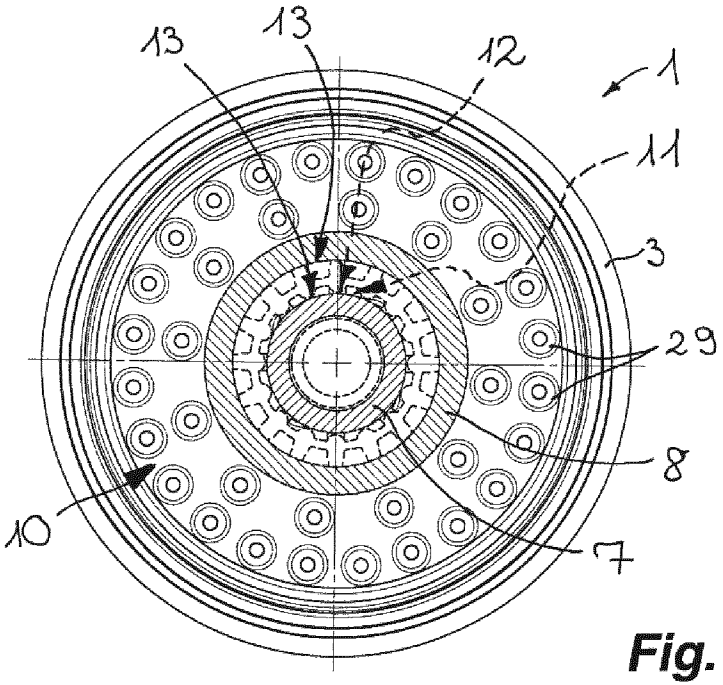
FIG. 3 shows the inert unit from FIGS. 1 and 2 in a top view of the inflow side of a jet splitter located in the jet regulator and of the throughflow-quantity regulator connected upstream on the inflow side.

FIGS. 1 to 3 show a sanitary insert unit 1 which can be fitted on the water outlet of a sanitary outlet fitting. The insert unit 1 has an insert housing 2 which bears a radially protruding annular flange 3 circumferentially in its inflow-side edge region. The insert housing 2 is insertable into a sleeve-shaped outlet mouthpiece until the annular flange 3 lies on an annular step on the inner circumference of the outlet mouthpiece, not illustrated here.

The insert unit 1 has a throughflow-quantity regulator unit 4 which adjusts the quantity of water flowing therethrough per unit of time to a defined maximum value irrespective of the pressure. At least one substantially annular throughflow channel 5, 6 of the throughflow-quantity regulator unit 4 is provided with an annular flow-restricting body 7, 8 of elastic material which, between itself and an adjacent channel wall bearing a control profiling 24 consisting of internal and external formations 11, 12 oriented in the throughflow direction, bounds a control gap 13, the passage cross section of which varies by the flow-restricting body 7, 8 deforming under the differential pressure forming during the flow therethrough. The flow-restricting body in the throughflow channels 5, 6 which each form a throughflow-quantity regulator is moulded to a greater or lesser extent into the control profiling 24 depending on the water pressure, and the clear control gap 13 correspondingly changes.

The throughflow-quantity regulator unit 4 here has two concentric throughflow channels 5, 6 in which a respective elastic flow-restricting body 7, 8 is placed. The inner throughflow channel 5 having a smaller diameter is provided with a flow-restricting body 7 which has a smaller material cross section, in particular a smaller chord size, in comparison to the flow-restricting body 8 located in the outer throughflow channel 6 having a larger diameter, and therefore also more easily reacts to low water pressures and water pressure changes.

A jet regulator 9 which is intended to shape the incoming water into a homogeneous, non-sputtering and optionally sparkling-soft water jet is arranged on the outflow side of the throughflow-quantity regulator unit 4. This jet regulator 9 has a jet splitter 10 which is designed as a perforated plate and has a plurality of throughflow holes 29, which jet splitter 10 in the insert housing 2 first of all divides the water coming from the throughflow-quantity regulator unit 4 into a multiplicity of individual jets.

So that the water still arriving at a high speed from the throughflow-quantity regulator unit 4 does not flow directly and un-braked through the throughflow holes 29 in the jet splitter 10, the projection of at least one of the throughflow channels 5, 6 is arranged in a perforation-free annular zone 27 of the jet splitter 10, that is to say, a perforation-free annular zone 27 of the jet splitter 10 is provided in the axial extension of at least one of the throughflow channels 5, 6.

In the throughflow holes 29 of the perforated plate, the water flowing therethrough emerges at an increased speed causing a negative pressure on the outflow side of the perforated plate, which negative pressure sucks ambient air into the housing interior of the insert housing 2. For this purpose, aeration openings 28 are provided in the housing wall of the insert housing 2 in the annular zone placed directly below the jet splitter 10, which is in the form of a perforated plate. The individual jets coming from the jet splitter 10 are thoroughly mixed with the ambient air in the housing interior of the insert housing 2—in the mixing zone placed below the jet splitter 10 in the housing interior. In order also additionally to facilitate said thorough mixing and in order to further brake the water, insert parts 14, 15 can be inserted in the insert housing 2, said insert parts having, within an outer annular wall 16, a lattice or mesh structure consisting of webs 17, 18 crossing one another at crossing junctions.

Concentric webs 17 cross here with radial webs 18 and form a mesh structure at which the water is divided yet further and mixed. The insert parts 14, 15 are adjoined on the outflow side by a flow rectifier 19 with outlet openings 20, which outlet openings 20 have a comparatively high longitudinal extent in comparison to the hole cross section. In the outlet openings 20 of said flow rectifier 19, the water emerging there is shaped to form a homogeneous outlet jet. The flow rectifier 19 here forms the outlet-side end surface of the insert unit 1. A housing constriction 21 which prevents an undesirable spraying to the side of the emerging water jet is provided on the outflow side of the flow rectifier 19.

So that the water does not emerge as an unstable annular jet and so that the emerging water also has a homogeneous jet cross section, at least one throughflow hole 29 and—like here—preferably a plurality of throughflow holes 29 is/are provided in the central region 22 of the jet splitter, said central region being bounded by the projection of the at least one throughflow channel 5, 6.

So that, despite the perforation-free annular zone 12, a sufficient number of throughflow holes 29 can still be placed in the perforated plate serving as the jet splitter 10, the throughflow channels 5, 6 are separated from each other by an annular wall 23, wherein the control profilings 24 of the throughflow channels 5, 6, which are arranged concentrically with respect to one another, are provided on the inner side and the outer side of said annular wall 23. The perforation-free annular zone 27 can thereby be configured to be comparatively narrow.

The throughflow holes 29 of the jet splitter 10, which throughflow holes are arranged outside the projection of the throughflow channels 5, 6, are arranged on at least one circular path and—as here—preferably on at least two circular paths. The circular paths having the throughflow holes 29 are arranged here concentrically with respect to one another and to the projection of the at least one throughflow channel 5, 6.

As becomes clear in particular from the longitudinal section in FIG. 2, the throughflow holes 29 in the jet splitter 10 which is in the form of a perforated plate have an inflow hole portion 25 and an outflow hole portion 26. While the inflow hole portion 25 tapers in a funnel-shaped manner in the throughflow direction, the outflow hole portion 26 has a substantially cylindrical clear hole cross section.

LIST OF REFERENCE SIGNS

1 Insert unit
2 Insert housing
3 Annular flange
4 Throughflow-quantity regulator unit
5 Inner throughflow channel
6 Outer throughflow channel
7 Inner flow-restricting body
8 Outer flow-restricting body
9 Jet regulator
10 Jet splitter
11 Internal formations
12 External formations
13 Control gap
14 Insert part
15 Insert part
16 Annular wall
17 Concentric webs
18 Radial webs
19 Flow rectifier
20 Outlet openings of the flow rectifier 19
21 Housing constriction
22 Central region
23 Annular wall
24 Control profiling
25 Inflow hole portion
26 Outflow hole portion
27 Annular zone
28 Aeration openings
29 Throughflow holes

The invention claimed is:

1. A sanitary insert unit (1) that is fittable on a water outlet of a sanitary outlet fitting, the sanitary insert unit comprising:

a throughflow-quantity regulator unit (4) having at least one annular throughflow channel (5, 6) having at least one channel wall which includes a control profiling (24) thereon, and at least one annular flow-restricting body (7, 8) of elastic material in the at least one annular throughflow channel (5, 6), a control gap (13) bounded by said at least one flow-restricting body (7, 8) and the channel wall that bears the control profiling (24), a passage cross section of the control gap (13) is variable by the flow-restricting body (7, 8) deforming under a differential pressure that forms during a flow of water therethrough;

a jet regulator (9) arranged on an outflow side of the throughflow-quantity regulator unit (4);

the jet regulator including a jet splitter (10) which divides the water coming from the throughflow-quantity regulator unit (4) into individual jets, the jet splitter (10) comprises a perforated plate having a perforation-free annular zone (27);

wherein an imaginary extension of at least one of the at least one annular throughflow channel (5, 6) is arranged in the perforation-free annular zone (27); and at least one throughflow hole (29) is provided in a central region (22) of the jet splitter (10) and extends through the perforated plate in a longitudinal throughflow direction of the sanitary insert unit, said central region is bounded by the imaginary extension of the at least one throughflow channel (5, 6), and the at least one throughflow hole (29) of the jet splitter (10) has an inflow hole portion (25) and an outflow hole portion (26).

2. The sanitary insert unit according to claim 1, wherein the throughflow-quantity regulator unit (4) two of the annular throughflow channels (5, 6) arranged concentrically with respect to each other, and comprises two of the annular flow-restricting bodies, with one of the annular flow restricting bodies located in each of the annular throughflow channels.

3. The sanitary insert unit according to claim 2, wherein the throughflow channels (5, 6) are separated from each other by an annular wall (23), and the control profilings (24) of said throughflow channels (5, 6) are provided on an inner side and an outer side of said annular wall (23).

4. The sanitary insert unit according to claim 2, wherein one of the throughflow channels (5) has a smaller diameter than another of the throughflow channels and the flow-restricting body (7) for the one of the throughflow channels has a smaller cross section than the flow-restricting body for the other of the throughflow channels.

5. The sanitary insert unit according to claim 4, wherein the flow-restricting body (7) with the smaller cross section has a smaller chord size, in comparison to the flow-restricting body (8) located in the other of the throughflow channels (6) that has a larger diameter which is located outwardly from the one of the throughflow channels (5) with the smaller diameter.

6. The sanitary insert unit according to claim 1, wherein the at least one throughflow hole comprises throughflow holes (29), and the throughflow holes (29) of the jet splitter (10) are arranged outside the projection of the at least one throughflow channel (5, 6), on at least one circular path.

7. The sanitary insert unit according to claim 6, wherein the at least one circular path comprises at least two circular paths, the throughflow holes are arranged on the at least two circular paths, and the circular paths having the throughflow holes (29) are arranged concentrically with respect to one another.

8. The sanitary insert unit according to claim 6, wherein the at least one circular path of the throughflow holes (29) comprises two of the circular paths.

9. The sanitary insert unit according to claim 8, wherein the circular paths having the throughflow holes (29) are arranged concentrically with respect to the imaginary extension of the at least one throughflow channel (5, 6).

10. The sanitary insert unit according to claim 1, wherein the inflow hole portion (25) of the throughflow holes (29) tapers with a funnel-shape in the longitudinal throughflow direction.

11. The sanitary insert unit according to claim 10, wherein the outflow hole portion (26) has a cylindrical clear hole portion.

* * * * *